73-152
3/29/88 XR 4,733,725 SR

United States Patent [19]
Pittaway et al.

[11] Patent Number: 4,733,725
[45] Date of Patent: Mar. 29, 1988

[54] SINGLE WELL TEST FOR EVALUATING $CO_2$ INJECTION

[75] Inventors: Kenneth R. Pittaway; J. Scott Moore; James C. Albright, all of Ponca City, Okla.

[73] Assignee: Conoco Inc., Ponca City, Okla.

[21] Appl. No.: 882,990

[22] Filed: Jul. 7, 1986

[51] Int. Cl.[4] ..... E21B 49/00
[52] U.S. Cl. ..... 166/252; 73/152
[58] Field of Search ..... 73/15 L; 166/250, 25 L, 166/270, 273

[56] References Cited

U.S. PATENT DOCUMENTS

| | | | |
|---|---|---|---|
| 2,623,596 | 12/1952 | Whorton et al. | 166/274 |
| 3,084,743 | 4/1963 | West et al. | 166/274 X |
| 3,282,095 | 11/1966 | Owens | 73/151 |
| 3,878,890 | 4/1975 | Fertl et al. | 73/152 X |
| 3,894,584 | 7/1975 | Fertl | 166/250 |
| 4,034,810 | 7/1977 | Holloway | 166/274 |
| 4,090,398 | 5/1978 | Deans et al. | 73/19 |
| 4,099,565 | 7/1978 | Sheely, Jr. et al. | 166/252 |
| 4,102,396 | 7/1978 | Ransom et al. | 166/252 |
| 4,168,746 | 9/1979 | Sheely | 166/252 |
| 4,349,737 | 9/1982 | Smith et al. | 250/259 |
| 4,380,266 | 4/1983 | Wellington | 166/252 |
| 4,397,181 | 8/1983 | Caldwell | 73/152 |
| 4,589,486 | 5/1986 | Brown et al. | 166/252 |
| 4,628,999 | 12/1986 | Kiss et al. | 166/268 X |

FOREIGN PATENT DOCUMENTS 652317 3/1979 U.S.S.R. .

*Primary Examiner*—George A. Suchfield
*Attorney, Agent, or Firm*—A. Joe Reinert

[57] ABSTRACT

A test is provided for evaluating and/or designing an enhanced oil recovery process including $CO_2$ injection. A modified log-inject-log technique is utilized to determine residual $CO_2$ saturation and incremental hydrocarbon displacement.

15 Claims, No Drawings

SINGLE WELL TEST FOR EVALUATING $CO_2$ INJECTION

BACKGROUND OF THE INVENTION

1. Field Of The Invention

The invention relates to evaluation of and/or design of $CO_2$ flooding processes for enhanced oil recovery.

2. Description Of The Prior Art

A great need exists to recover additional hydrocarbons from subterranean formations after primary production is no longer economical. Recovery processes involving mobilizing and moving hydrocarbons through a hydrocarbon bearing subterranean formation from an injection well to a production well by injecting a mobilizing fluid into the injection well are well known. One example of such a mobilizing fluid is a fluid comprising $CO_2$.

One of the factors inhibiting more rapid development of such enhanced recovery methods is the tailoring of a process to a reservoir. Hydrocarbon bearing reservoirs are each unique and can respond in many unexpected and unpredictable ways to such enhanced recovery processes.

At present, the general practice is to use all of the knowledge available including laboratory data and reservoir properties to design a best evaluation of what will technically be feasible and cost effective in the reservoir, and then to conduct a pilot test project for each reservoir to prove out or redesign the flood process. These pilot projects, however, are very protracted sometimes taking several years to conduct, and run into costs of many millions of dollars.

It has also been suggested that such enhanced oil recovery projects can be designed and/or evaluated by various single well tests. Examples of such tests are shown in U.S. Pat. No. 4,099,565 to Sheely, Jr., et al. and U.S. Pat. No. 4,168,746 to Sheely, both assigned to the assignee of the present invention.

SUMMARY OF THE INVENTION

The present invention provides a single well test procedure particularly adapted to evaluating and/or designing an enhanced oil recovery project involving $CO_2$ flooding.

The invention is particularly useful in determining two important parameters, namely residual $CO_2$ saturation and incremental oil displacement.

The residual $CO_2$ saturation is the amount of $CO_2$ which is typically left in the formation after the $CO_2$ flooding project is completed, and thus represents an economic loss of $CO_2$ which cannot be recovered.

The incremental oil displacement is a measurement of the amount of the oil in place which will be produced as a result of the $CO_2$ flood.

In its broadest aspect with regard to measurement of residual $CO_2$ concentrations, the process includes steps of:

(a) determining an initial combined hydrocarbon plus water saturation in a volume in the formation near a well bore penetrating the formation;

(b) injecting sufficient fluid comprising $CO_2$ into the well bore to mobilize and move hydrocarbons from said volume in the formation;

(c) injecting sufficient water saturated with $CO_2$ into the injection well to displace substantially all of the fluid comprising $CO_2$ from the volume in the formation which can be moved by fluid displacement; and (d) determining a post flush combined hydrocarbon plus water saturation in said volume in the formation, so that a residual $CO_2$ saturation can be determined.

With regard to determination of incremental oil displacement, the invention in its broadest aspect can be described as including the steps of:

(a) determining an initial hydrocarbon saturation in the formation in a volume in the formation near a well bore penetrating the formation;

(b) injecting sufficient of the fluid comprising $CO_2$ into the well bore to mobilize and move hydrocarbons from said volume in the formation;

(c) injecting water into said well bore and dissolving substantially all residual $CO_2$ remaining in said volume in the formation; and (d) determining a final hydrocarbon saturation in said volume in the formation.

Typically, a single well test process will include both the determination of residual $CO_2$ saturation and a determination of incremental oil production, although those parameters can be determined separately as just described.

A general object of the present invention is to reduce the amount of time and capital investment needed to determine key $CO_2$ process parameters, namely residual $CO_2$ saturation and incremental oil displacement.

Numerous, more specific objects, features and advantages of the present invention will be readily apparent to those skilled in the art upon a reading of the following disclosure.

DETAILED DESCRIPTION OF THE PREFERRED EMBODIMENTS OF THE INVENTION

The process of this invention may be used to obtain data which is useful to evaluate the effectiveness of or to design an enhanced recovery process.

The enhanced recovery processes contemplated involve mobilizing and moving hydrocarbons through a hydrocarbon bearing subterranean formation from an injection well to a production well by injecting a fluid comprising $CO_2$ into the injection well. The hydrocarbons are produced through the production well. Typically, a calculated slug of fluid comprising $CO_2$ is injected into the injection well. The volume of this slug will be sufficient to provide the desired interaction with the hydrocarbon deposits to mobilize the same. The slug of fluid comprising $CO_2$ is then followed by water injection which is continued for so long as any significant amount of hydrocarbon is produced at the production wells.

The two particular parameters of interest which can be determined by the single well test of the present invention, and which are very useful in designing a full-scale $CO_2$ flooding process, are the residual $CO_2$ saturation and the incremental hydrocarbon displacement.

A preferred combined process for determining both residual $CO_2$ saturation and incremental hydrocarbon displacement generally includes nine steps as follows:

(1) Sufficient high salinity brine is injected into a well bore penetrating the formation and thus into the formation to displace all formation water from a volume of the formation which will be investigated by logging tools;

(2) The well bore is then logged with logging tools which respond to the amount of brine and to the total brine plus hydrocarbon present in the formation;

(3) A fluid comprising $CO_2$ is then injected in a sufficient amount to treat the volume of the formation which will be investigated by the logging tools;

(4) Brine of the same salinity as used in step (1), and saturated with $CO_2$, is then injected into the well bore and into the formation to displace substantially all of the fluid comprising $CO_2$ that can be displaced by fluid displacement from the volume of the formation which will be investigated by the logging tools;

(5) The well bore is again logged to determine brine saturation and total brine plus oil saturation in the volume of the formation being investigated by the logging tools;

(6) Sufficient low salinity water is then injected into the well bore and into the formation to substantially completely dissolve all $CO_2$ remaining in the volume of the formation being investigated by the logging tools;

(7) The well bore is again logged to determine brine saturation and total brine plus oil saturation in the volume of the formation being investigated;

(8) High salinity brine of the same salinity as in step (1) is again injected into the well bore and into the formation to displace the low salinity water of step (6) from the volume of the formation being investigated; and (9) Finally, the well is again logged to determine final brine saturation and final combined hydrocarbon plus brine saturation in the volume of the formation being investigated.

This single well test process is preferably carried out on an open uncased well bore to reduce well bore effects on the logs.

The various logging steps listed above can be conducted with commercially available logging tools including those responding to the thermal neutron capture cross-section for the amount of brine present, and the Neutron Porosity log for the amount of brine plus oil. One particular thermal neutron capture cross-section log which may be utilized is that provided by the Schlumberger Corporation and known as the TDT-M log. That log provides two curves of primary interest. The first is a neutron capture cross-section curve. The second is a ratio curve from two detectors in the logging instrument, which ratio curve responds primarily to changes in hydrogen saturation, which in turn depends mainly on the combined water and oil saturations.

Other logs which could be used for brine measurement include various resistivity logs, dielectric logs, and logs which detect energy of gamma rays created by neutron absorption or inelastic scattering.

It is noted that if little or no gas is present in the formation, the combined water plug oil saturation can be determined by running the Neutron Porosity log (which is a part of step (2)) prior to the brine injection of step (1).

In the processes of the present invention, the various steps must be performed to an extent sufficient to completely effect the desired change on a volume in the formation near the well bore. The volume which should be effected is the volume which can be evaluated by the particular logging tools being utilized. It will be appreciated by those skilled in the art that a given logging instrument will investigate a volume of the formation extending for a radius from the well bore which will generally be known or can be determined.

Thus, the various steps of the present process, such as for example the injection of fluid comprising $CO_2$, should be carried out until such time as the desired effect is created in the entire volume of the formation which it is desired to evaluate with the logging tools.

Also, it will be appreciated that the formation typically is comprised of multilayered zones of varying permeability. A given step should be conducted for a period of time sufficient to effect the desired change in the lowest permeability layer of interest in the zone of interest of the formation. That is, for example, when injecting fluid comprising $CO_2$, a sufficient volume of fluid should be injected to permeate the entire volume of the formation being investigated including the layer of interest of that volume which has the lowest permeability thus insuring that all other layers of interest are also completely treated.

DETERMINATION OF RESIDUAL $CO_2$ SATURATION

The residual $CO_2$ saturation behind the post flush displacing fluids of step (4) is given by the difference between brine plus hydrocarbon saturation of the logs of step (2) and the brine plug hydrocarbon saturation of the logs of step (5), before and after $CO_2$ injection, respectively.

The purpose of step (4) in which brine saturated with $CO_2$ is injected to displace substantially all of the $CO_2$ that can be displaced by fluid displacement is to simulate the situation present in a formation in a $CO_2$ flooding project after the $CO_2$ injection phase has been followed by a long-term water flood phase.

In the full-scale $CO_2$ flood project, after $CO_2$ injection stops, water injection begins. As water is injected into the injection well and begins spreading radially outward therefrom toward the various production wells, the water will rather quickly become saturated with $CO_2$ and then will not absorb any additional $CO_2$ as the water continues to flow radially outward to the production wells. Thus, after the water flooding has begun, a situation will arise in which substantially all of the fluid comprising $CO_2$ which can be displaced by fluid displacement will have already been displaced to the production wells. Thereafter, further $CO_2$ will be removed from the formation only by solution thereof into the injection water.

At any given point in time, there will be a front moving slowly radially outward from the injection well, which front is defined as the dividing line between newly injected water between the injection well and the front, which is not yet saturated with $CO_2$, and water between the front and the production wells which has been completely saturated with $CO_2$.

It is believed that during the normal $CO_2$ flood project, and after completion of the follow-up water flooding, the vast majority of the formation still will contain water saturated with $CO_2$, and only a relatively small portion of the formation will have had the $CO_2$ completely removed therefrom by the dissolving mechanism.

Thus, in the single well test process of the present invention, it is desired to displace such $CO_2$ as can be displaced by a fluid displacement mechanism, but not to dissolve any $CO_2$ from the volume of the formation being examined.

This is accomplished in the fourth step of the nine-step procedure outlined above, in which $CO_2$ saturated brine is injected into the well bore to displace as much fluid comprising $CO_2$ as possible by a pure fluid displacement mechanism, without dissolving any substantial amount of $CO_2$ from the volume of the formation being examined.

It will be appreciated, as previously mentioned in the introductory parts of this specification, that if it is only desired to determine the residual $CO_2$ saturation, the same can be accomplished by an abbreviated process including generally steps (1), (2), (3), (4) and (5) of the nine-step procedure outlined above.

INCREMENTAL OIL DISPLACEMENT

The incremental oil displacement due to $CO_2$ injection is given by the difference between the water saturation prior to $CO_2$ injection provided by the logs of step (2), and water saturation after final brine injection as given by the logs of step (9).

Since all remaining $CO_2$ has been removed from the formation by dissolving the same, all changes in the measured water saturation result from a decrease in hydrocarbon saturation.

Again, it will be appreciated that if it is desired only to obtain the data on incremental oil production, the same can be accomplished by steps (1), (2), (3), (6), (8) and (9) of the nine-step procedure outlined above.

Additionally, it is noted that step (6) of injecting relatively fresh water to dissolve $CO_2$ from the formation can be accomplished with the use of brackish water or brine, but will generally take a longer period of time. The solution of $CO_2$ into brine as compared to fresh water takes relatively longer because there is already so much material dissolved in the brine.

THE LOGS OF STEP (7)

Additionally, it will be appreciated that the logs of step (7) are not directly utilized in determining either residual $CO_2$ saturation or incremental oil displacement. The logs of step (7), instead, may be utilized to determine the effects of the formation matrix on the other logs in order to allow actual water and oil saturation at each step to be more accurately determined.

As will be appreciated by those skilled in the art, two sets of logs wherein the only variable is the salinity of the water which saturates the formation, can be compared to determine the effect on logs of the rock matrix. The use of the logs of step (7), however, are not generally a part of the inventive aspects of the present invention and need not be further described at this point.

To facilitate a better understanding of the invention, the following example is given.

EXAMPLE

A test is run in the San Andres formation in MCA365Y, Maljamar Field, N. Mex. The subsurface formation under investigation has 192 feet of net pay as defined using a cutoff porosity of six percent. Average porosity for this section is about thirteen percent and average initial oil saturation is forty-three percent. An initial log is run utilizing the Schlumberger TDT logging technique to measure both water saturation and combined hydrocarbon plus water saturation. Then, 1300 barrels of high salinity brine are injected. A second TDT log is then run to measure both water saturation and combined hydrocarbon plus water saturation. A fluid comprising $CO_2$ is then injected in an amount equivalent to 200 barrels of liquid $CO_2$. Then, 1300 barrels of brine saturated with $CO_2$ are injected. A third post flush TDT log is then run to measure both water saturation and combined hydrocarbon plus water saturation. Relatively fresh water is then injected for a period of several weeks to dissolve all residual $CO_2$ from the formation; the exact length of this fresh water injection is determined by periodically running a TDT log and comparing the successive logs to determine whether any measurable change in $CO_2$ saturation has taken place. Then, 1300 barrels of high salinity brine is injected to displace the fresh water from the volume of the formation under investigation. Then a final TDT log is run to measure both water saturation and combined hydrocarbon plus water saturation. A comparison of the combined hydrocarbon plus water saturation prior to and after $CO_2$ injection shows a residual $CO_2$ saturation in the range of twenty to thirty percent. A comparison of water saturation before $CO_2$ injection and after the final brine injection shows that the oil saturation was changed by an average of nineteen percent of pore volume, or forty-four percent of the initial oil in place.

Thus, it is seen that the processes of the present invention readily achieve the ends and advantages mentioned as well as those inherent therein. While certain preferred embodiments of the invention have been described for the purposes of the present disclosure, numerous changes in the arrangement and execution of the various steps may be made by those skilled in the art which changes are encompassed within the scope and spirit of the present invention as defined by the appended claims.

What is claimed is:

1. A process for obtaining data useful to evaluate the effectiveness of or to design an enhanced recovery process, the recovery process involving mobilizing and moving hydrocarbons through a hydrocarbon bearing subterranean formation from an injection well to a production well by injecting a fluid comprising $CO_2$ into the injection well, said process comprising steps of:

(a) injecting sufficient brine into a well bore penetrating the formation to displace substantially all formation water from a volume in the formation near the well bore;

(b) logging the well bore to determine an initial brine saturation and an initial combined hydrocarbon plus brine saturation in said volume in the formation;

(c) injecting sufficient fluid comprising $CO_2$ into the well bore to mobilize and move hydrocarbons from said volume in the formation;

(d) injecting sufficient brine saturated with $CO_2$ into the well bore to displace substantially all of the fluid comprising $CO_2$ from said volume in the formation which can be moved by fluid displacement;

(e) logging the well bore to determine a post flush brine saturation and a post fluid combined hydrocarbon plus brine saturation in said volume in the formation;

(f) injecting sufficient relatively fresh water into said well bore to dissolve substantially all residual $CO_2$ remaining in said volume in the formation;

(g) injecting sufficient brine into the well bore to displace substantially all of said relatively fresh water from said volume in the formation; and (h) logging the well bore to determine a final brine saturation and a final combined hydrocarbon plus brine saturation in said volume in the formation.

2. The process of claim 1, further comprising a step of:

determining a residual $CO_2$ saturation by comparing the post flush combined hydrocarbon plus brine saturation of step (e) to the initial combined hydrocarbon plus brine saturation of step (b).

3. The process of claim 1, further comprising a step of:

determining an incremental hydrocarbon displacement due to $CO_2$ injection by comparing the final brine saturation of step (h) to the initial brine saturation of step (b).

4. A process for obtaining data useful to evaluate the effectiveness of or to design an enhanced recovery process, the recovery process involving mobilizing and moving hydrocarbons through a hydrocarbon bearing subterranean formation from an injection well to a production well by injecting a fluid comprising $CO_2$ into the injection well, said process comprising steps of:

(a) determining an initial combined hydrocarbon plus water saturation in a volume in the formation near a well bore penetrating the formation;

(b) injecting sufficient of the fluid comprising $CO_2$ into the well bore to mobilize and move hydrocarbons from said volume in the formation;

(c) injecting sufficient water saturated with $CO_2$ into the injection well to displace substantially all of the fluid comprising $CO_2$ from said volume in the formation which can be moved by fluid displacement; and (d) determining a post flush combined hydrocarbon plus water saturation in said volume in the formation, so that a residual $CO_2$ saturation can be determined.

5. The process of claim 4 further comprising a step of:

determining said residual $CO_2$ saturation by subtracting the post flush combined hydrocarbon plus water saturation of step (d) from the initial hydrocarbon plus water saturation of step (a).

6. The process of claim 4, wherein:

step (a) includes steps of:

injecting sufficient water, having a suffient salinity for good log response, into said well bore to displace substantially all formation water from said volume in the formation; and logging the well bore to determine said initial combined hydrocarbon plus water saturation in said volume in the formation;

step (c) is further characterized in that said water saturated with $CO_2$ is water having a sufficient salinity for good log response; and step (d) is further characterized in that said post flush combined hydrocarbon plus water saturation is determined by logging said well bore.

7. The process of claim 4, wherein said step (a) includes steps of:

injecting sufficient water, having a sufficient salinity for good log response, into said well bore to displace substantially all formation water from said volume in the formation; and logging the well bore to determine said initial combined hydrocarbon plus water saturation in said volume in the formation.

8. The process of claim 7, wherein the water of step (a) is saturated brine.

9. The process of claim 4, wherein:

step (c) is further characterized in that said water saturated with $CO_2$ is water having a sufficient salinity for good log response; and step (d) is further characterized in that said post flush combined hydrocarbon plus water saturation is determined by logging said well bore.

10. The process of claim 9, wherein the water of step (c) is saturated brine.

11. A process for obtaining data useful to evaluate the effectiveness of or to design an enhanced recovery process, the recovery process involving mobilizing and moving hydrocarbons through a hydrocarbon bearing subterranean formation from an injection well to a production well by injecting a fluid comprising $CO_2$ into the injection well, said process comprising sequentially steps of:

(a) determining an initial hydrocarbon saturation in a volume in the formation near a well bore penetrating the formation;

(b) injecting sufficient of the fluid comprising $CO_2$ into the well bore to mobilize and move hydrocarbons from said volume in the formation;

(c) injecting relatively fresh water into said well bore and dissolving substantially all residual $CO_2$ remaining in said volume in said volume in said formation;

(d) injecting sufficient water having a sufficient salinity for good log response into the well bore to displace substantially all of said relatively fresh water of step (c) from said volume in the formation; and (e) logging the well bore to determine a final water saturation and a final hydrocarbon plus water saturation in said volume in the formation.

12. The process of claim 11, wherein said step (a) includes steps of:

injecting sufficient water, having a sufficient salinity for good log response, into said well bore to displace substantially all formation water from said volume in the formation; and logging the well bore to determine an initial water saturation and an initial combined hydrocarbon plus water saturation in said volume in the formation.

13. the process of claim 12, wherein the water of step (a) is saturated brine.

14. The process of claim 11, further comprising a step of:

(f) during step (c), periodically logging said well bore to detect the presence of $CO_2$ in said volume in said formation; and wherein step (c) is further characterized in that said injection of relatively fresh water to dissolve residual $CO_2$ is continued until $CO_2$ can no longer be detected by the logging of step (f).

15. The process of claim 14, wherein:

the injection of water in step (c) continues for a period of at least approximately three weeks.

* * * * *